US006708339B1

(12) United States Patent
Smith, Jr.

(10) Patent No.: US 6,708,339 B1
(45) Date of Patent: Mar. 23, 2004

(54) SPORT HELMET FACE GUARD

(76) Inventor: James Smith, Jr., 1258 Sultan Cir., Carson, CA (US) 90746

( * ) Notice: Subject to any disclaimer, the term of this patent is extended or adjusted under 35 U.S.C. 154(b) by 0 days.

(21) Appl. No.: 10/421,573

(22) Filed: Apr. 22, 2003

(51) Int. Cl.[7] ..... A42B 1/00; A63B 71/10
(52) U.S. Cl. ..... 2/9; 2/425
(58) Field of Search ..... 2/9, 424, 425, 2/423

(56) References Cited

U.S. PATENT DOCUMENTS

| | | | | |
|---|---|---|---|---|
| 2,780,815 A | | 2/1957 | Newland | |
| 2,785,405 A | | 3/1957 | Snyder | |
| 2,986,739 A | | 6/1961 | Rozzi, Sr. | |
| 3,067,427 A | * | 12/1962 | McClintock, Sr. | 2/9 |
| 3,423,758 A | * | 1/1969 | Heacox | 2/424 |
| 3,886,596 A | | 6/1975 | Franklin et al. | |
| 4,390,995 A | * | 7/1983 | Walck | 2/9 |
| 4,885,806 A | | 12/1989 | Heller | |
| 4,958,697 A | | 9/1990 | Moody | |
| 4,985,938 A | | 1/1991 | Snow, Jr. | |
| 5,301,372 A | * | 4/1994 | Matoba | 2/424 |
| 5,477,565 A | | 12/1995 | Hunt, Jr. | |
| 5,661,849 A | | 9/1997 | Hicks | |

* cited by examiner

*Primary Examiner*—Rodney M. Lindsey
(74) *Attorney, Agent, or Firm*—Charles H. Thomas

(57) ABSTRACT

A face guard for a sport helmet, such as a rigid, protective baseball batting helmet or football helmet, is provided with one or more resilient couplings that permit the face guard grid to be attached to the helmet at ear hole openings in the side flaps of the helmet. The resilient couplings have one or more radial, annular channels defined therein. At least one of these channels is of a size to fit snugly within the confines of a side flap ear opening on the helmet. The structure of the resilient coupling thereby defines a resiliently compressible helmet attachment flange for insertion through an ear opening in one of the ear flaps of the helmet and a resiliently compressible mounting clip attachment flange for insertion into the helmet attachment opening of the mounting clip. The face guard may thereby be releaseably coupled to and detached from the sport helmet without any modification to the helmet whatsoever and in a manner that protects the helmet from damage.

18 Claims, 6 Drawing Sheets

SPORT HELMET FACE GUARD

BACKGROUND OF THE INVENTION

1. Field of the Invention

The present invention is a face guard that may be attached to a sport helmet of the type utilized in baseball, football, and other sports as well.

2. Description of the Prior Art

For many years sport helmets have been utilized to protect a sporting participant from head injuries. Conventional helmets of this type are typically formed of rigid plastic and are shaped as a unitary structure that covers the crown of a person's head and which also has side flaps that protect the sides of a person's head and which cover the ears of the wearer. Protective helmets of this type are particularly important to safeguard the well-being of children and adolescents, since such individuals are younger, more inexperienced, and therefore likely to make many mistakes in playing a sport that could result in very serious injury without some form of protection.

Protective helmets of this type are particularly important for use by batters in the game of baseball since the head injury resulting from a ball thrown quite hard by a pitcher can be a very serious matter indeed. Moreover, in juvenile sports, the person pitching the ball will often throw a pitch with considerable speed, but with very erratic accuracy. It is therefore important for a batter to be protected as much as possible from a pitched ball. While conventional baseball helmets provide suitable protection to the top and sides of the head of a player, the helmet itself cannot provide protection to the players face, since it would obscure a players vision.

Various face guards have been designed for attachment to a baseball or football helmet so as to provide face protection for the player. Conventional devices of this type provide a grid of rigid bars that pass across the players face and are secured to the opposing sides of the helmet. However, such conventional devices typically require some type of modification to the structure of the helmet.

Some face guards have been constructed so as to avoid drilling extra holes in a sport helmet or to avoid mounting devices permanently attached to the basic helmet. Some of these involve threaded ferrules that are screwed together through the ear holes of the side flaps to clamp the side ends of the face guard to the structure of the helmet. However, when the components of such devices are screwed together to clamp the structure of the helmet therebetween, they often produce excessive stress on the plastic structure of the helmet so that the helmet cracks and must be discarded. Such devices have therefore not been commercially successful.

SUMMARY OF THE INVENTION

The present invention provides a sport helmet face guard that not only can be attached to the helmet without any modification or alteration whatsoever to the helmet, but also a system that avoids damage to the helmet by the attachment mechanism. The present invention departs from prior approaches employing rigid structural attachment mechanisms, and instead employs at least one resilient coupling to firmly, but removable secure the face guard to the helmet.

The invention involves a face guard that may be attached to a conventional baseball batting helmet. It may also be used in the sport of football and attached to a conventional football helmet. In fact, the invention may be utilized with any sporting helmet that is formed as a rigid structure and which has portions at the side of the wearer's head with openings at the location of the ears.

The key aspect of the invention is that the face guard can be attached to and detached from the sports helmet without any modification to the helmet itself and without danger of damaging the helmet. Helmets of this type are invariably provided with openings at the ear positions of the wearer. The face guard of the invention is attached to the helmet by one or more resilient connectors or couplings at these ear openings.

Attachment is by means of a reasonably stiff, but somewhat flexible, resilient, rubber ear hole attachment piece. The attachment piece has a generally disc-shaped configuration with at least one, and preferably a pair of mutually parallel channels defined in the periphery of the otherwise disc-shaped structure. The provision of these channels defines an inboard disc-shaped flange that can be resiliently deformed and inserted through the ear hole opening with the remaining portion of the attachment piece residing on the exterior of the helmet at the ear position. The outer, generally disc-shaped flange of each attachment piece or coupling may also be resiliently deformed and inserted through an opening in a mounting clip on one side of the face guard, or a pair of attachment mounting clips on the face guard located on both of the opposing sides of the helmet.

The attachment member or mounting clips of the face guard are preferably flat, plate-like, washer-shaped structures with a circular central opening therethrough. However the mounting clips need not necessarily be complete rings, but can have a C-shaped configuration which will still require resilient deformation of the mounting clip engaging piece or flange that fits into the mounting clip. The face guard may also employ a pair of short wire rod stabilizers that hook around the edges of the helmet at the corners of the face opening.

In one broad aspect the present invention may be considered to be a face guard for a sport helmet having side flaps with ear openings defined therethrough. The face guard of the invention is comprised of an open face protection grid of rigid bars curved convex forward and having opposing side ends. At least one rigid mounting clip having a helmet attachment opening defined therein is secured to at least one of the side ends of the face protection grid. At least one resilient coupling is provided having an arcuate, helmet engagement channel defined therein. This channel is sized to fit snugly within the confines of either one of the side flap ear openings. The channel thereby defines a resiliently compressible helmet attachment flange for insertion through an ear opening in one of the ear flaps of the helmet. The resilient coupling also defines a resiliently compressible mounting clip attachment flange for insertion into the helmet attachment opening in the mounting clip.

The face guard of the invention can be constructed as a guard that extends only across half the face of a wearer. Such a device is very useful for attachment to a baseball batting helmet in which the greatest danger of exposure to injury is to the side of the batter's face nearest the pitcher. Such a half face guard has an advantage of less obstruction to the view of the batter since the area obscured by the bars of the grid is minimized. In such a device there is a mounting clip only on the side end of the grid closest to the pitcher. In such a device a single resilient coupling is utilized. For a right-handed batter the mounting clip is located on the left side of the grid and is attached to the left ear hole of the helmet by the single resilient coupling employed. For a left-handed batter the attachment would be at the right ear opening of the helmet.

While a half face guard does have certain advantages, it does require different structures for right-handed batters and left-handed batters. Consequently, in a preferred embodiment of the invention the open face protection guard of rigid bars provides a full protection for the entire face of the wearer and has separate rigid mounting clips at each of the side ends of the face protection guard. In this embodiment a pair of resilient couplings are employed.

Therefore, in a preferred aspect, the present invention may be defined as a face guard for a sport helmet having side flaps with ear openings defined therethrough. The face guard is comprised of an open face protection grid of rigid bars curved convex forward and having opposing side ends positionable alongside the helmet side flaps externally thereof. A separate rigid mounting clip having a helmet attachment opening defined therein is secured to each of the side ends of the face protection grid. A pair of resilient couplings are provided. Each of these couplings has an arcuate helmet engagement channel defined therein of a size to fit snugly within the confines of one of the side flap ear openings. A resiliently compressible helmet attachment flange for insertion through an ear opening in one of the ear flaps and a resiliently compressible mounting clip attachment flange for insertion into the helmet attachment opening in the mounting clip are thereby defined.

In still another aspect the invention may be considered to be the combination of a sport helmet having a pair of opposing side flaps with ear openings defined therethrough and a face guard having an open face protection grid of rigid bars curved concave forward and having opposing side ends, at least one rigid mounting clip, and at least one resilient coupling. The mounting clip has a helmet attachment opening defined therein that is secured to at least one of the side ends of the face protection grid. The resilient coupling has an arcuate, helmet engagement channel defined therein. This channel is sized to snugly fit within the confines of either one of the side flap ear openings in the helmet. The resilient coupling thereby defines a resiliently compressible helmet attachment flange for insertion through an ear opening in one of the ear flaps, and a resiliently compressible mounting clip attachment flange for insertion into the helmet attachment opening in the mounting clip.

The invention may be described with greater clarity and particularity by reference to the accompanying drawings.

DESCRIPTION OF THE EMBODIMENT

Figure 1:
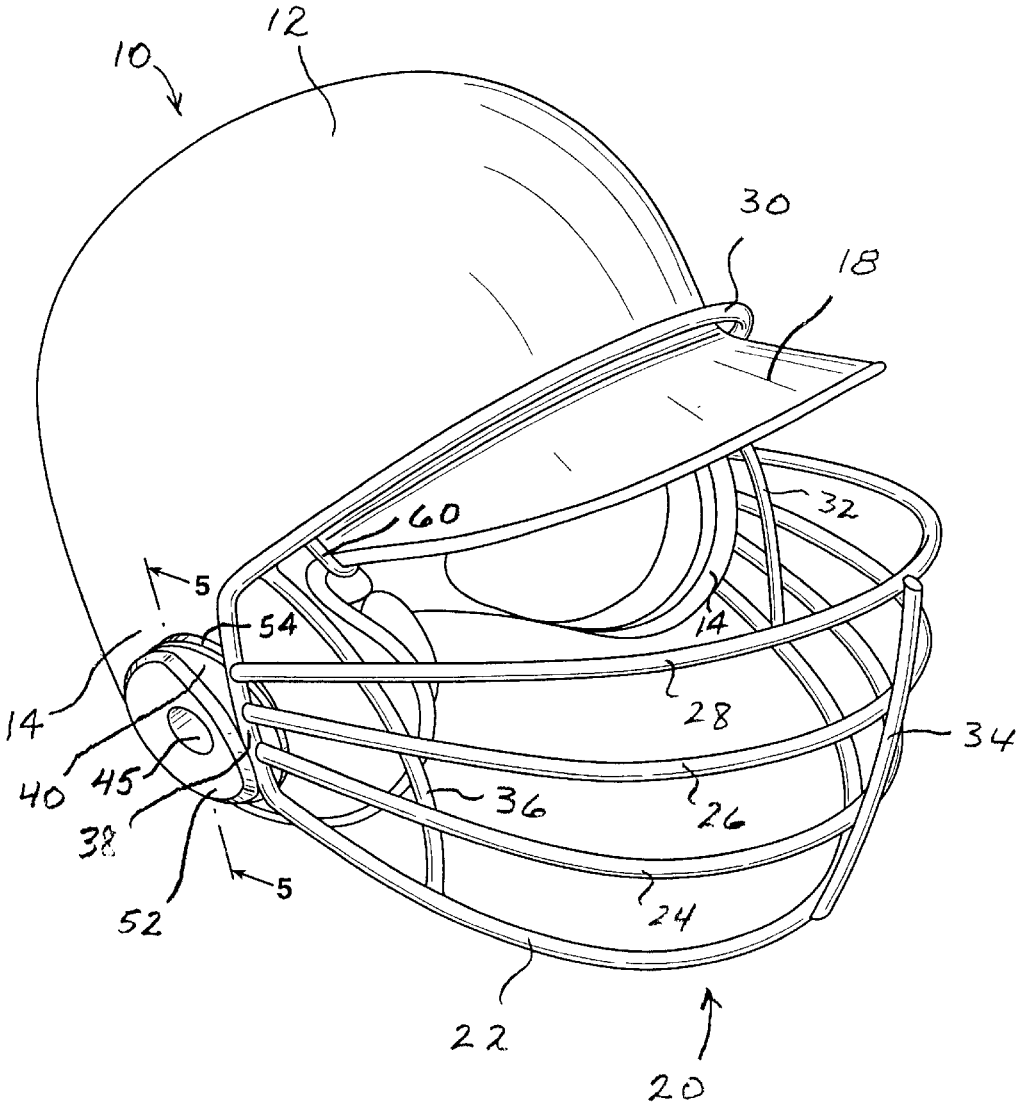
FIG. 1 is a perspective review of one preferred embodiment in a combination employing a face guard according to the invention.
Figure 2:
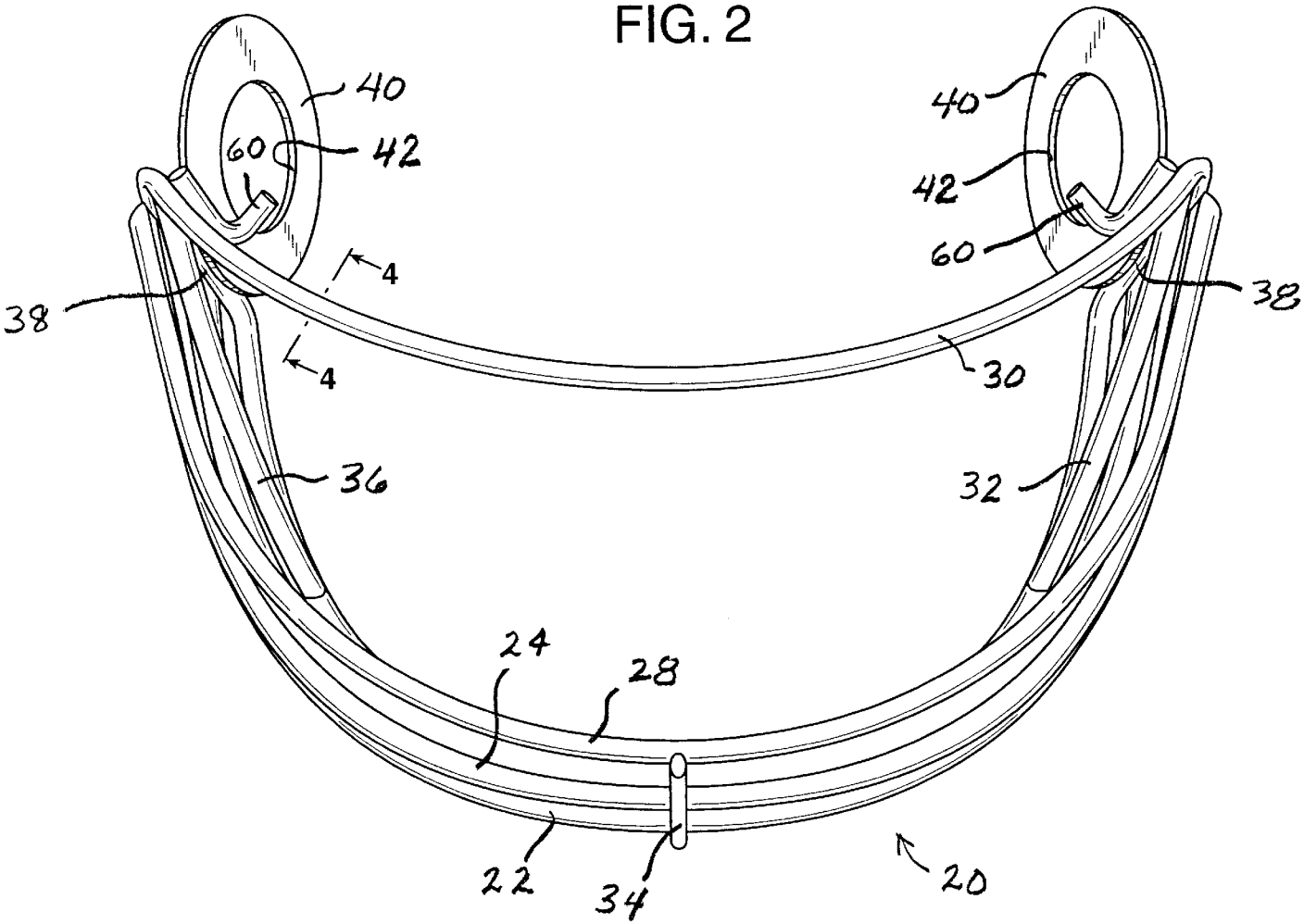
FIG. 2 is a top plan view of the face guard shown in FIG. 1.

FIG. 1 illustrates a sport helmet 10, which in the embodiment illustrated is a baseball batting helmet of the type widely utilized in organized youth sporting programs. The helmet can may be formed of any durable, stiff rigid plastic, such as Delrin, polyvinyl chloride, ABS, etc. It could also be formed of some other rigid materials, such as aluminum. The helmet 10 is a unitary, molded structure and has a dome-shaped crown 12 that covers the crown of the wearer's head and the back of the wearer's neck. The helmet 10 also has a pair of integrally formed opposing side flaps 14 that extend alongside the sides of the wearer's head outboard from the wearer'sears. Each of the side flaps 14 is provided with a circular ear opening 16, indicated in FIG. 5. The sport helmet 10 is also provided with a forwardly projecting bill 18 extending forward from the crown portion 12 above and between the side flaps 14.

Figure 3:
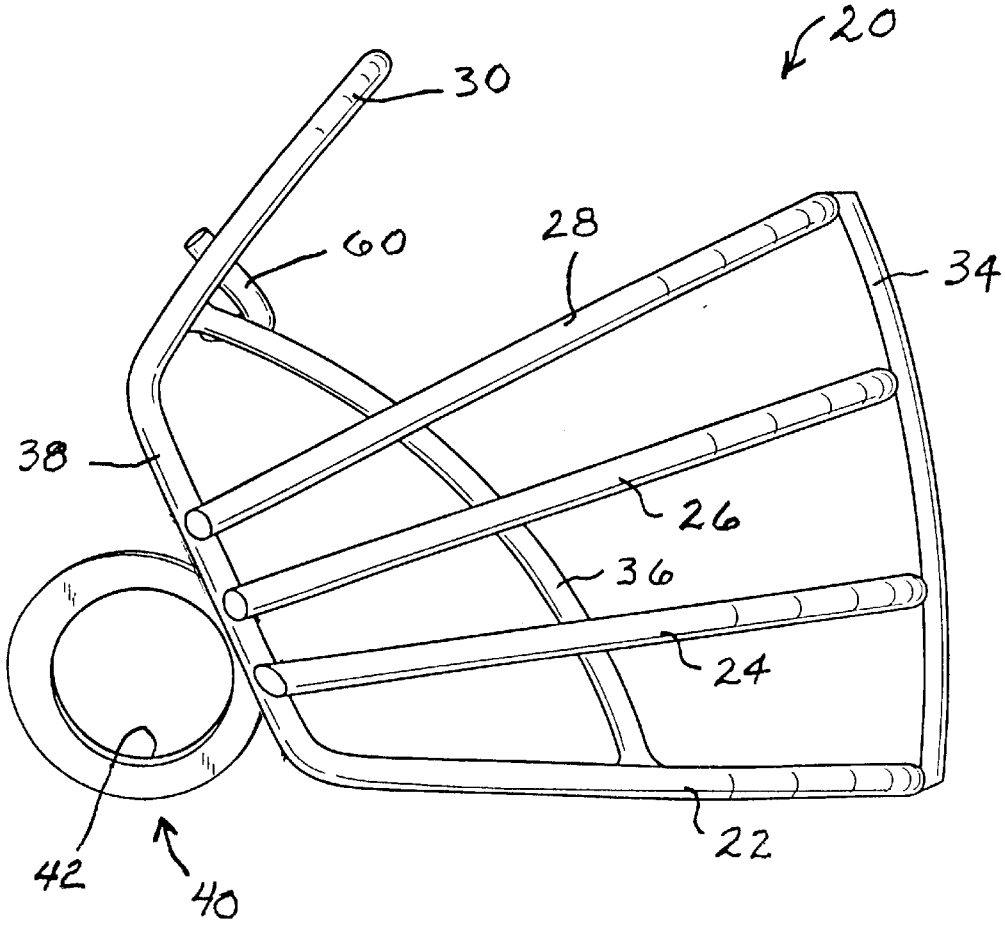
FIG. 3 is a side elevational view of the face guard shown in FIG. 1.

The combination illustrated in FIG. 1 also includes an open face protection grid 20 formed of rigid bars 22, 24, 26, 28, 30, 32, 34, and 36. These bars are preferably formed of steel rod or wire stock and are welded together at their various points of contact. The face protection grid 20 is curved convex forward and has opposing side ends 38 and a pair of mounting clips 40. As illustrated in FIG. 3, each of the mounting clips 40 has a helmet attachment opening 42 defined therein. The mounting clips 40 are secured to the side ends 38 of the face protection grid 20.

Figure 6:
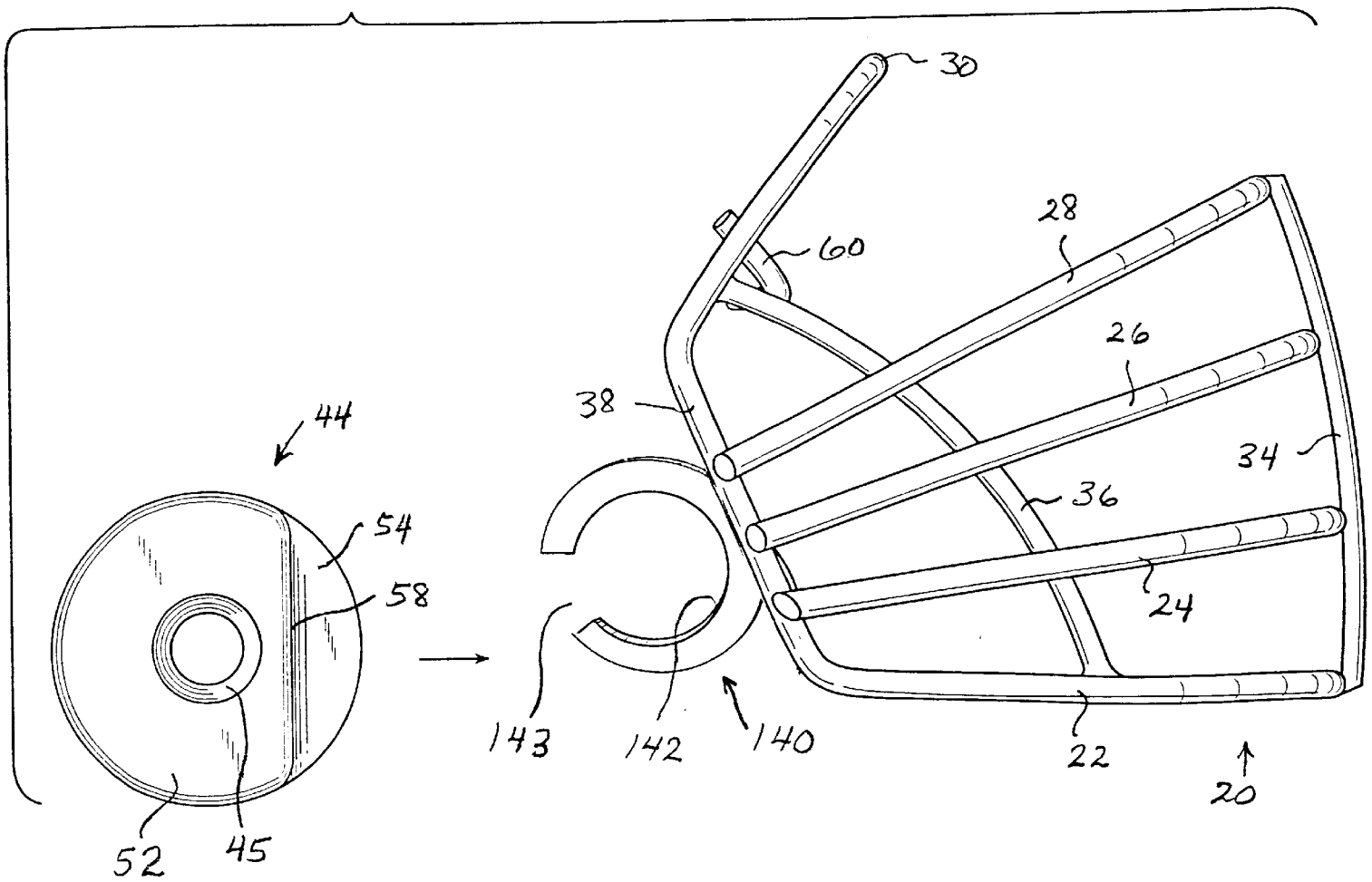
FIG. 6 is a side elevational view that illustrates an alternative embodiment of a face guard according to the invention.
Figure 7:
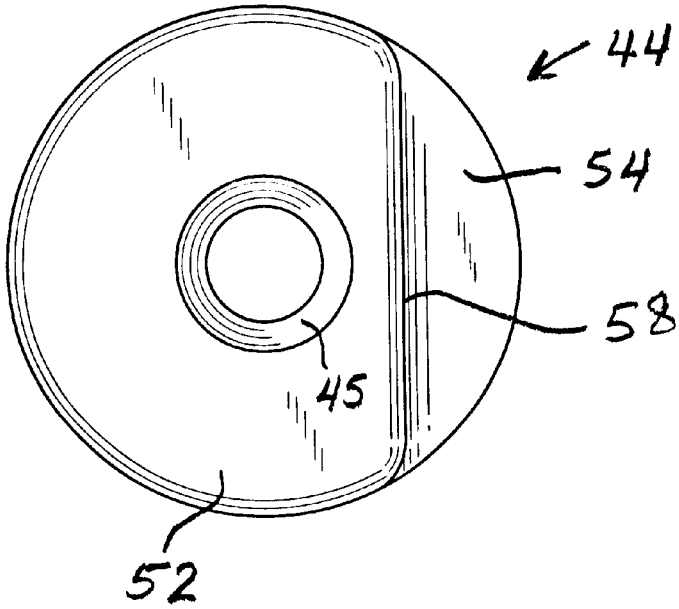
FIG. 7 is a side elevational view of one of the resilient couplings employed according to the invention as illustrated in FIG. 1, shown in isolation.
Figure 8:
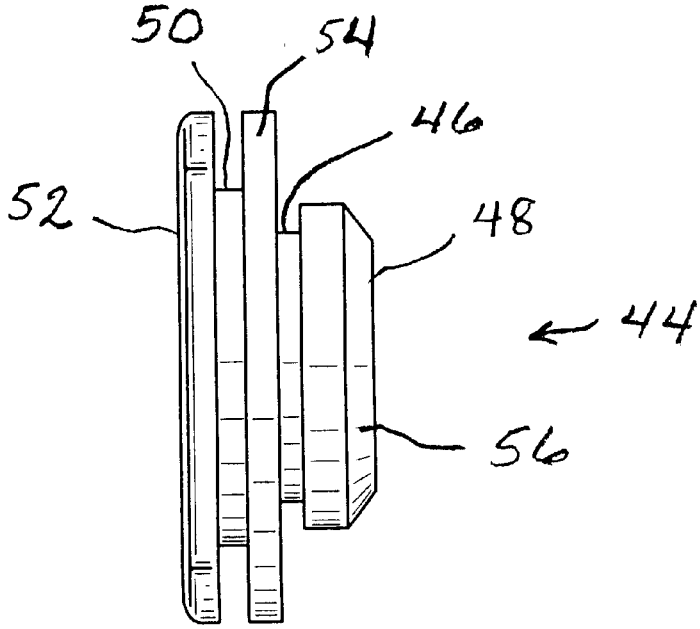
FIG. 8 is a front elevational view of the coupling illustrated in FIG. 7.

The combination illustrated in FIG. 1 also employs a pair of resilient couplings 44, one of which is illustrated in isolation in FIGS. 7 and 8. Each of the resilient couplings 44 has a generally disc-shaped configuration, as illustrated in FIGS. 6, 7, and 8, and has a central, frustoconical opening 45 defined therethrough. One purpose of the central opening 45 is to provide the wearer with an opening leading to the wearer's ear so that the wearer's hearing is not totally obstructed. Another purpose of the opening 45 is to enhance the extent of compressibility of the resilient coupling 44.

Figure 5:
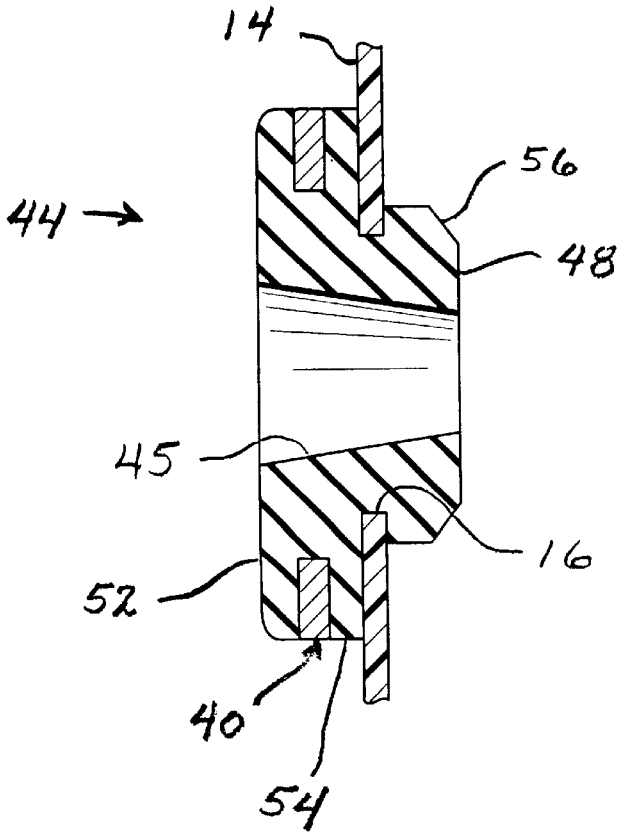
FIG. 5 is a cross-sectional detail view taken along the lines 5—5 in FIG. 1.

Each resilient coupling 44 is preferably formed of a stiff, but resiliently compressible rubber or rubber based material. Each of the resilient couplings 44 has an arcuate, helmet engagement channel 46 defined therein. The channel 46 is visible in the isolated view of the resilient coupling 44 shown in FIG. 8. The helmet engagement channel 46 is sized to snugly fit within the confines of either one of the side flap ear openings 16, as illustrated in FIG. 5. The helmet engagement channel 46 thereby defines a resiliently compressible annular helmet attachment flange 48 for insertion through an ear opening 16 of one of the ear flaps 14 of the helmet 10.

Each of the resilient couplings 44 also has an arcuate, mounting clip engagement channel 50 defined therein parallel to and located outboard from the helmet engagement channel 46. The mounting clip engagement channel 50 is sized to snugly fit within the helmet attachment opening 42 of the mounting clip 40. The structure of the resilient coupling 44 thereby delineates a resiliently compressible mounting clip attachment flange 52 and a disc-shaped cushioning pad 54. The cushioning pad 54 is located between the helmet attachment flange 48 and the mounting clip attachment flange 52 and is delineated therefrom by the radial, annular channels 46 and 50, respectively, defined in the structure of the resilient coupling 44.

The helmet attachment flange 48 has a generally disc-shaped, circular, annular configuration with a frustoconical surface 56 that facilitates insertion of the helmet attachment flange 48 through an ear opening 16 of one of the helmet side flaps 14. As illustrated in FIG. 7, the mounting clip attachment flange 52 is also essentially a disc-shaped flange having a circular, annular configuration, but from which a forwardly facing segment is removed as indicated by the chord edge 58.

As illustrated in FIGS. 1 through 4 and 6, the face protection grid 20 is formed with a plurality of convex, curved, laterally oriented, vertically spaced, face shielding bars, namely the bars 22, 24, 26, and 28. These bars are curved convex forwardly and terminate at their extremities at the steel mounting clips 40. The mounting clip attachment bars 38 are formed by the same wire or steel rod stock that forms the arcuately curved lowermost face shielding bar 22 and the bar 30. The mounting clip attachment bars 38 are welded to the mounting clips 40. The other bars 32, 34, and 36 are bracing bars that interconnect the face shielding bars to each other. The bracing bars are secured to the face shielding bars by welded connections at the locations at which the bracing bars pass across and contact the face shielding bars. This results in a face protection grid 20 that is thereby quite rigid and protects the wearer's face even from a hard object thrown at a high-speed, such as a pitched baseball.

The face protection grid 20 is further comprised of a laterally oriented helmet bill-engaging bar 30 that is arcuately curved to terminate at the mounting clips 40. The helmet bill-engaging bar 30 is located above the uppermost face shielding bar 28. The helmet bill-engaging bar 30 is configured to conform to the curvature of the location on the helmet 10 at which the bill 18 is delineated from the crown portion 12 of the helmet 10. The bill-engaging bar 30 thereby serves to prevent the face shielding grid 20 from dropping down to expose the wearer's face.

Figure 4:
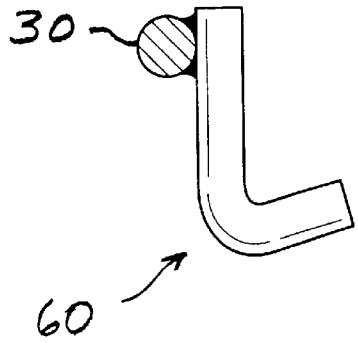
FIG. 4 is a cross-sectional detail view taken along the lines 4—4 in FIG. 2.

As illustrated in FIGS. 1 and 4, the preferred embodiment of the invention employing the face protection grid 20 is also comprised of downwardly and inwardly projecting hooks 60 that are formed of short segments of bent steel or wire stock. The hooks 60 are welded to the bill-engaging bar 30 at laterally spaced separation from each other and are configured to engage the helmet 10, preferably at approximately the location of the demarcation between the bill 18 and the helmet side flaps 14. The hooks 60 prevent the face protection grid 20 from rising or being pulled out of position in front of the face of the wearer. Together the bill-engaging bar 30 and the hooks 60 stabilize the location of the face protection grid 20 relative to the helmet 10 and prevent it from rotating relative thereto at the ear hole openings 16.

In the embodiment of the invention illustrated in FIG. 3 the mounting clip 40 is a flat plate formed as a disc or washer having a completely annular shape. The sections 38 of the rigid stock forming the bill engagement bar 30 and the foremost face protection bar 22 are welded to the forward edges of the disc-shaped or ring shaped mounting clips 40.

To attach the face protection grid 20 to the helmet 10 the mounting clip attachment flanges 52 of the two resilient couplings 44 on the opposing side ends of the protective grid 20 are resiliently deformed and forced from the inboard side through the central, circular openings 42 in the mounting clips 40. When released, the resilient, mounting clip attachment flanges 52 reside outboard from the outwardly facing surfaces. of the mounting clips 40 and thereby capture the mounting clips 40 within the mounting clip receiving channels 50. Because a segment of the otherwise circular shape of the mounting clip attachment flange 52 is removed, clearance is provided to accommodate the presence of the face grid attachment bar 38 and the terminal ends of the face protection bars 22, 24, 26, and 28 and the terminal ends of the bill engagement bar 30.

The face protection grid 20 is then brought into position in front of the face opening of the helmet 10 with the resilient couplings 44 located outboard from the helmet side flaps 14, with the bars and the helmet engaging hooks 60 of the face protection grid 20 substantially in the position as illustrated in FIG. 1. The structures of the helmet side flaps 14 and the steel bar stock forming the face protection grid 20 has enough resiliency to allow the resilient couplings 44 to be initially located totally outboard from the side flaps 14. The resiliently compressible helmet attachment flanges 48 are thereupon forced inwardly through the ear openings 16 in the helmet side flaps 14 and, when released, engage the helmet side flaps 14 as illustrated in FIG. 5. The face guard of the invention is thereby securely, but releaseably attached to the helmet 10. It is significant that this manner of attachment requires no modification whatsoever to the structure of the helmet 10.

It makes no difference whether the resilient couplings 44 are first attached to the mounting clips 40 or to the ear flaps 14 of the helmet 10. The order of coupling of the resilient couplings to the helmet 10 and to the mounting clips 40 is at the user's discretion.

It should be further noted that the protective grid 20 with the mounting clips 40 at its ends can be completely removed from the helmet 10 by pushing the mounting clip attachment flanges 52 back through the openings 42 in the mounting clips 40. The resilient couplings 44 can be left attached to the helmet 10 with the protective grid separated therefrom, if desired.

FIG. 6 illustrates an alternative embodiment of the invention which employs mounting clips 140 in place of the mounting clips 40. The mounting clips 140 are formed as flat, C-shaped structures with a central opening 142 and with a slotted, radial opening 143 directed away from the protective grid 20 of rigid bars. With this embodiment of the invention, the mounting clips 140 can be attached to the resilient couplings 40 by pressing the slotted openings 143 thereof against the structure of the resilient couplings 44 at the mounting clip receiving channels 50 thereof. The structures of the resilient couplings 44 are sufficiently compressible to allow the ends of the slotted C-shaped mounting clip 140 to pass behind the structure of the releaseable couplings 44 at the mounting clip receiving channels 50. The C-shaped mounting clips 140 thereby releaseably capture the resilient couplings 44 in the manner of a C-shaped washer.

Undoubtedly, numerous variations and modifications of the invention will become readily apparent to those familiar with protective guards for sports helmets. For example, mounting clips and resilient couplings of alternative configurations may be substituted for those illustrated and described. Also, various configurations of elements of the protection grid may be employed to hold the protection grid 20 in position relative to the helmet 10. In addition, while the presence of a cushioning pad 54 between the ear attachment flange and the mounting clip attachment flange is highly desirable, it is not absolutely essential. The resilient couplings according to the invention could be constructed with a single channel that delineates the helmet attachment flange from the mounting clip attachment flange. In such a construction the mounting clips reside in contact with the outside surfaces of the ear flaps. Accordingly, the scope of the invention should not be construed as limited to the specific embodiments depicted and described, but rather is defined in the claims appended hereto.

I claim:

1. A face guard for a sport helmet having side flaps with ear openings defined therein comprising:

an open space protection grid of rigid bars curved convex forward and having opposing side ends, at least one rigid mounting clip having a helmet attachment opening defined therein secured to at least one of said side ends of said face protection: grid, and a resilient coupling having an arcuate helmet engagement channel defined therein sized to snugly fit within the confines of one of said side flap ear openings, thereby defining a resiliently compressible helmet attachment flange for insertion through an ear opening in one of said side flaps and a resiliently compressible mounting clip attachment flange for insertion into said helmet attachment opening in said mounting clip.

2. A face guard according to claim 1 wherein said resilient coupling has an arcuate mounting clip engagement channel defined therein parallel to and located outboard from said helmet engagement channel and said mounting clip engagement channel is sized to snugly fit within said helmet attachment opening of said mounting clip, thereby delineating a cushioning pad in said resilient coupling located between said channels defined therein.

3. A face guard according to claim 2 wherein said resilient coupling has a disc-shaped configuration with a central opening defined therethrough.

4. A face guard according to claim 2 wherein said helmet attachment flange has a circular annular shape.

5. A face guard according to claim 2 wherein said mounting clip attachment flange has a circular annular configuration from which a segment is removed.

6. A face guard according to claim 2 wherein said mounting clip is formed of a flat, annular disc.

7. A face guard according to claim 2 wherein said mounting clip is formed as a flat C-shaped structure.

8. A face guard according to claim 7 wherein said C-shaped structure has an opening directed away from said grid of rigid bars.

9. A face guard for a sport helmet having side flaps with ear openings defined therethrough comprising:

an open-face protection grid of rigid bars curved convex forward and having opposing side ends positionable alongside of said helmet side flaps outboard therefrom, separate rigid mounting clips each having a helmet attachment opening defined therein secured to said side ends of said face protection grid, and a pair of resilient couplings, each having an arcuate helmet engagement channel defined therein of a size to fit snugly within the confines of one of said side flap ear openings, thereby defining a resiliently compressible helmet attachment flange for insertion through an ear opening in one of said side flaps and a resiliently compressible mounting clip attachment flange for insertion into said helmet attachment opening in said mounting clip.

10. A face guard according to claim 9 wherein said rigid bars include a plurality of laterally oriented, vertically spaced face shielding bars that are arcuately curved and terminate at said mounting clips, and a plurality of bracing bars that interconnect said face shielding bars to each other, and further comprising a laterally oriented helmet bill engaging bar that is arcuately curved to terminate at said mounting clips and which is located above the uppermost of said face shielding bars so as to receive a helmet bill therebetween.

11. A face guard according to claim 10 further comprising hooks projecting downwardly and inwardly from said helmet bill engaging bar to engage said helmet between said side flaps.

12. In combination, a sport helmet having a pair of opposing side flaps with ear openings defined therethrough and a forwardly projecting helmet bill located above and between said opposing side flaps, a face guard formed with an opening grid of rigid bars curved convex forward and having opposing side ends positioned alongside said helmet side flaps outboard therefrom, and a pair of rigid mounting clips each having a helmet attachment opening defined therein secured to said side ends of said face protection grid, and a pair of resilient couplings, each having an arcuate helmet engagement channel defined therein of a size to snugly fit within the confines of one of said side flap ear openings, thereby defining a resiliently compressible helmet attachment flange for insertion into and through said ear openings in said side flaps and resiliently compressible mounting clip attachment flanges for insertion into said helmet openings in said mounting clips.

13. A combination according to claim 12 wherein each of said resilient couplings has an arcuate mounting clip engagement channel defined therein parallel to and located outboard from said helmet engagement channel and said mounting clip engagement channels are sized to snugly fit within said helmet attachment openings of said mounting clips, thereby delineating cushioning pads in said resilient couplings located between said channel defined therein, and each of said resilient couplings has a central opening defined therethrough.

14. A combination according to claim 13 wherein said helmet attachment flanges are circular and annular in shape.

15. A combination according to claim 12 wherein said mounting clips are formed as flat, annular discs.

16. A combination according to claim 12 wherein said mounting clips are formed as flat, C-shaped plates in which said helmet attachment openings are directed away from said grid of rigid bars.

17. A face guard according to claim 12 wherein said rigid bars include a plurality of laterally oriented, vertically spaced face shielding bars that are arcuately curved and terminate at said mounting clips, and a plurality of bracing bars that interconnect said face shielding bars to each other, and further comprising a laterally oriented helmet bill engaging bar that is arcuately curved to terminate at said mounting clips and which is located above the uppermost of said face shielding bars so as to receive a helmet bill therebetween.

18. A face guard according to claim 17 further comprising hooks projecting downwardly and inwardly from said helmet bill engaging bar to engage said helmet between said side flaps.

* * * * *